United States Patent [19]

Erwin et al.

[11] Patent Number: 4,674,885

[45] Date of Patent: Jun. 23, 1987

[54] MIXING LIQUIDS OF DIFFERENT VISCOSITY

[75] Inventors: Lewis Erwin, Winchester; John Arimond, Cambridge, both of Mass.

[73] Assignee: Massachusetts Institute of Technology, Cambridge, Mass.

[21] Appl. No.: 688,755

[22] Filed: Jan. 4, 1985

[51] Int. Cl.[4] ..... B28C 7/04

[52] U.S. Cl. ..... 366/76; 366/98; 366/348

[58] Field of Search ..... 366/69, 71, 76, 96–99, 366/348, 349; 422/901

[56] References Cited

U.S. PATENT DOCUMENTS 3,854,702 12/1974 Papenmeier ..... 366/348 X
4,065,105 12/1977 Lussiez et al. ..... 366/348
4,379,525 4/1983 Nowicki et al. ..... 366/98 X

OTHER PUBLICATIONS

Taylor, G. I., "The Viscosity of a Fluid Containing Small Drops of Another Fluid", *Proc. Roy. Soc.*, A–138, Dec. 1932, pp. 41–48.

Rumscheidt, F. D. & Mason, S. G., "Particle Motions in Sheared Suspensions. XII. Deformation and Burst of Fluid Drops in Shear and Hyperbolic Flow", *J. Colloid Sci.*, 16, 1961, pp. 238–261.

Taylor, G. I., "The Formation of Emulsions in Definable Fields of Flow", *Proc. Roy. Soc.*, A–146, May 1934, pp. 501–523.

Bartok, W. & Mason, S. G., "Particle Motions in Sheared Suspensions. VIII. Singlets and Doublets of Fluid Spheres", *J. Colloid Sci.*, 14, 1959, pp. 13–26.

*Primary Examiner*—Timothy F. Simone

[57] ABSTRACT

Liquids of different viscosity are mixed together more rapidly and with less energy consumption by elongating drops of the more-viscous liquid prior to mixing them into the less-viscous surrounding liquid. The more-viscous drops are elongated past a critical aspect ratio that is a function of the ratio of the viscosities of the two liquids and of the relative volume fractions they occupy. The rate at which the more-viscous drops mix into the surrounding liquid is dependent on the amount of shear strain required to stretch the drops to their critical aspect ratio, and thus, if the drops begin the mixing process already elongated, the rate of mixing is greater. In polymer blending operations, wherein a tumbled mixture of polymer pellets are melted and blended, the more-viscous pellets are elongated in the pelletizing operation. The mixing technique can be applied whenever the more-viscous drops are distributed discontinuously through a mixture, i.e., whenever they do not form a continously connected matrix. This occurs most often when the more-viscous liquid is in the minority, but may occur when it is in the majority.

23 Claims, 12 Drawing Figures

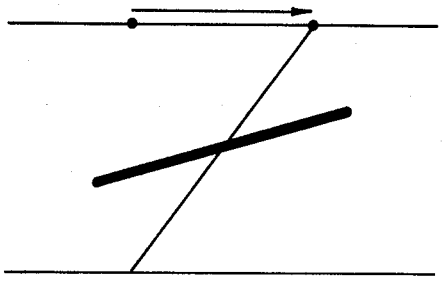
FIG 3 THE VELOCITY PROFILE THROUGH THE CENTER OF AN ELONGATING DROP
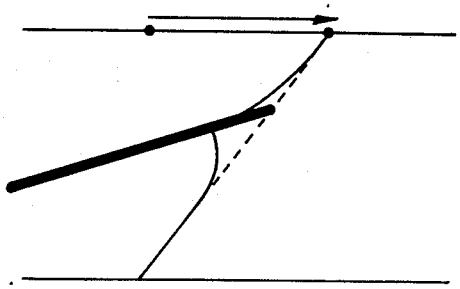
FIG 4 THE VELOCITY PROFILE THROUGH THE LEADING END OF AN ELONGATING DROP
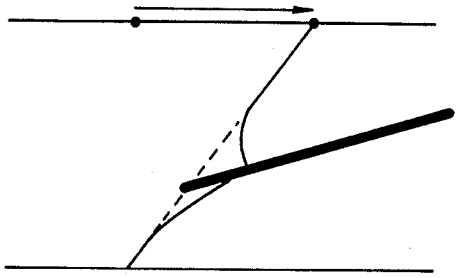
FIG 5 THE VELOCITY PROFILE THROUGH THE TRAILING END OF AN ELONGATING DROP
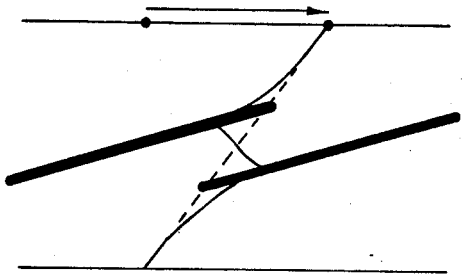
FIG 6 THE VELOCITY PROFILE THROUGH OVERLAPPING DROPS

MIXING LIQUIDS OF DIFFERENT VISCOSITY

BACKGROUND OF THE INVENTION

The invention relates to mixing liquids of different viscosities.

When drops of a viscous liquid are mixed into a less-viscous surrounding liquid (e.g., mixing an additive into a polymer melt), the drops will elongate. The elongation proceeds slowly at first, because the liquid in the more viscous drops resists deformation more strongly than does the less viscous surrounding liquid. As a result, the mixing process takes longer and consumes more energy. This situation arises often in polymer blending, wherein rubber or plastic materials are combined to synergize the useful properties of several materials. Polymer blending is often accomplished by melt blending a tumbled mixture of initially nearly spherical pellets of the several polymers.

This type of mixing has been a difficult problem to approach analytically. Even considering an idealized device which imparts a simple shear to a mixture, the distribution of fluid components of different viscosities gives rise to gross changes in actual flow patterns, and the stress, strain and velocity fields depend at any instant upon the geometry of component distribution. Such systems are not presently well understood, except in a severely simplified geometrical configuration known as the parallel-plate model, which is commonly described in polymer processing textbooks (e.g., McKelvey, J. M., *Polymer Processing,* Wiley & Sons, New York (1962); Tadmor & Gogos, *Principles of Polymer Processing,* Wiley & Sons, New York (1979)).

The problem of a viscous fluid drop suspended in a less viscous medium in shear was described in Taylor, G. I., "The Viscosity of a Fluid Containing Small Drops of Another Fluid", *Proc Roy Soc, A*-138, 41–48 (1932). Taylor's analysis predicts that in steady state the drop will experience shear and rotation such that the length and orientation of the drop's principal axes oscillate in an offsetting manner, giving the drop a mildly eccentric ellipsoidal envelope of constant shape and orientation. Other description of a fluid drop in a less viscous medium in shear have grown from Taylor's work: e.g., Bartok & Mason, "Particle Motions in Sheared Suspensions. VIII: Singlets and Doublets of Fluid Spheres", *J Colloid Sci,* 14, 13–26 (1959) and Rumscheidt & Mason, "Particle Motions in Sheared Suspensions. XII: Deformation and Burst of Fluid Drops in Shear and Hyperbolic Flow", *J Colloid Sci,* 16, 238–261 (1961).

SUMMARY OF THE INVENTION

We have discovered a previously unrecognized mechanism of laminar mixing between liquids of different viscosities. As more and more strain is imparted to a mixture of more-viscous drops in a surrounding less-viscous liquid, the drops elongate more and more rapidly until they reach a stage at which they deform as quickly as the surrounding liquid. We have discovered a critical drop length past which the two components being mixed deform equally. We have discovered a critical drop length to diameter ratio past which the two components being mixed deform equally. This critical aspect ratio (l/d) is a function of the ratio of the viscosities of the two liquids and of the relative volume fractions they occupy.

We have also discovered that the rate at which the more-viscous drops mix into the surrounding liquid is dependent on the amount of shear strain required to stretch the drops to their critical aspect ratio, and that if the drops, therefore, being the mixing process already elongated, the rate of mixing is greater.

In general the invention features elongating the drops of more-viscous liquid prior to mixing them into the surrounding liquid. In preferred embodiments, the more-viscous drops are elongated to an aspect ratio of at least 5.0 (more preferably at least 10.0); the aspect ratio is at least 50% (preferably 100%) of a critical aspect ratio; and in polymer blending operations, wherein a tumbled mixture of polymer pellets are melted and blended, the more-viscous pellets are elongated (preferably in the pelletizing operation).

The invention can be applied whenever the more-viscous drops are distributed discontinuously through a mixture, i.e., whenever they do not form a continuously-connected matrix. This occurs most often when the more-viscous liquid is in the minority, but may occur when it is in the majority.

The invention can reduce the time and energy consumed in the mixing process. Other features and advantages of the invention will be apparent from the following description of the preferred embodiment and from the claims.

DESCRIPTION OF THE PREFERRED EMBODIMENT

We turn now to a description of the preferred embodiment of the invention.

FIG. 3 is a velocity profile at the center of an elongating drop.

FIG. 4 is a velocity profile at the leading end of an elongating drop.

FIG. 5 is a velocity profile at the trailing end of an elongating drop.

FIG. 6 is a velocity profile at the region of overlap of two overlapping drops.

Figure 1:
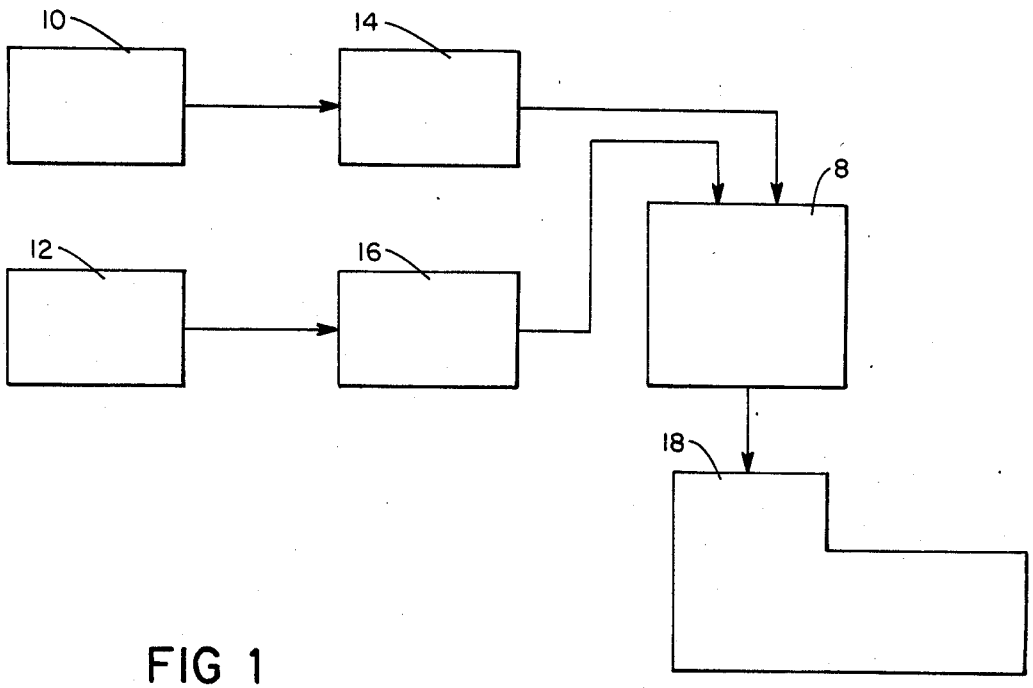
FIG. 1 is a block diagram of a polymer-melt blending process.
Figure 2:
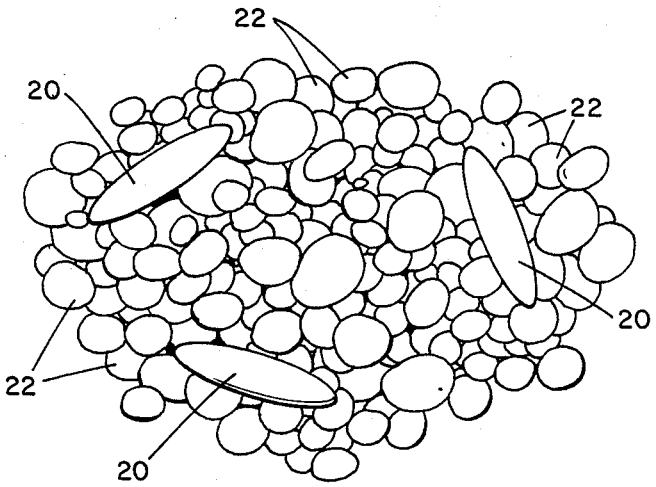
FIG. 2 is a diagrammatic view of a tumbled mixture of polymer-melt pellets prior to mixing.

Referring to FIG. 1, two different polymer melts stored in containers 10, 12 are blended at forming pellets of each in pelletizers 14, 16, blending the particles in blender 8 (e.g., tumbler), and mixing the pellets in melt blender 18 (e.g., extruder). FIG. 2 is a diagrammatic view of the tumbled mixture of pellets present in the hopper of the extruder. Pellets 20 are distributed discontinuously in the mixture and have a greater viscosity than pellets 22, which are distributed continuously (i.e., they form a continuous matrix between the walls of the shearing channel). The continuously distributed phase could consist of a powder or some other form different from pellets 22. (More-viscous pellets 20 are shown with an aspect ratio (l/d) of about 5.0. Other aspect ratios, including much greater ratios, are within the scope of the invention.)

To improve the rate at which the pellets mix together, the more-viscous pellets 20 are elongated to at least a critical aspect ratio, $(l/d)_{crit}$, described in more detail below. The less-viscous pellets can also be elongated, but it is not necessary.

Our discovery that improved mixing can be had by elongated the more-viscous pellets came from analysis of the mechanism by which the more-viscous drops become elongated. The mechanism can be illustrated by examining the velocity profile across a shear flow in which an elongating drop has been placed. The center of the drop can be assumed to translate with the velocity of the surrounding less-viscous liquid immediately adjacent to it, and thus a velocity profile passing through the center of the drop is the familiar linear profile of one-phase shear flow (FIG. 3). Because the drop is deforming at a rate slower than that of the less viscous surrounding liquid in which it is suspended, a velocity profile further down the mixing channel in the direction of shear departs from the linear profile (FIG. 4). The continuities of velocity and shear stress at the drop/medium interface suggest that the slope of the velocity profile—and therefore the shear stress—varies in the vicinity of the drop, reaching a maximum at the interface between the drop and the surrounding liquid. This causes the leading end of the drop to be tugged along by the surrounding liquid. A similar variation in velocity profile and shear stress occurs at the trailing end of the drop, and results in the trailing end being tugged backwards by the surrounding liquid (FIG. 5).

Thus tugging via local heightening of shear stress is the mechanism of drop elongation. The magnitude of this tugging increases for drops placed closer to the walls of the channel. This occurs because as a drop is positioned closer to a channel wall the deviation from a linear velocity profile required by the presence of the drop occurs over a smaller distance, thus requiring a steeper velocity gradient between the drop and the wall, which, in turn, means a higher shear stress at the interface between the drop and the surrounding liquid.

The magnitude of tugging is also greater when drops overlap each other. In the case of two elongating drops in the same shear flow, the velocity profiles of FIGS. 3–5 will occur if the drops do not overlap. But when the leading end of one drop overlaps the trailing end of the other, the continuities of velocity and shear stress produce a very steep velocity gradient in the region between the two drops (FIG. 6). This means that the local shear stress is even higher in that region, giving rise to even greater tugging forces on the overlapped ends of the two drops.

We have found that the rate of mixing increases as the drops elongate until the drops reach a critical aspect ratio, after which the drops deform at the same rate as the surrounding liquid. The critical aspect ratio is defined by the expression $$\left(\frac{l}{d}\right)_{crit} = \frac{3}{2}\left[-\ln \phi_v\left(\frac{\mu+}{\mu-}\right)\right]^{\frac{1}{2}}$$

wherein $(l/d)_{crit}$ is the critical aspect ratio, $\mu+$ is the viscosity of the more viscous drop, $\mu-$ is the viscosity of the surrounding liquid, and $\phi_v$ is the volume fraction occupied by the more viscous drops. After the elongating drops reach this critical aspect ratio, the drop/drop and drop/wall interactions are sufficiently strong that the drops begin to deform at the same rate as the surrounding liquid.

Figure 7:
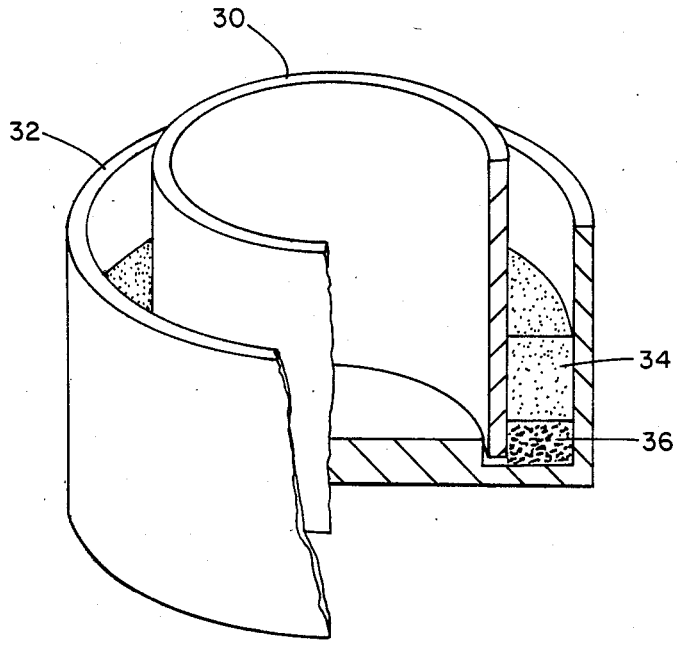
FIG. 7 is a perspective, partially cross-sectional, view of a coaxial cylinder mixer for mixing polymer-melt pellets.

To confirm our analytical results, experiments were conducted in which a tumbled mixture of polyethylene pellets (DuPont Alathon) was mixed in a coaxial cylinder mixer (FIG. 7) which was designed to impart a uniform shear to the tumbled mixture of pellets. Inner-cylinder 30 rotates, imparting shear on the mixture residing in the annular channel between the inner cylinder and a fixed outer cylinder 32. Black polyethylene pellets of high viscosity were mixed with one of three lower-viscosity white polyethylene pellets. The pellet material was as follows:

| Polyethylene | Color | Density ($g/cm^3$) | Melt Index |
|---|---|---|---|
| Alathon 1250 | black | .930 | 0.4 |
| Alathon 2010 | white | .919 | 1.9 |
| Alathon 1645 | white | .923 | 4.5 |
| Alathon 1570 | white | .915 | 15.0 |

Figure 8:
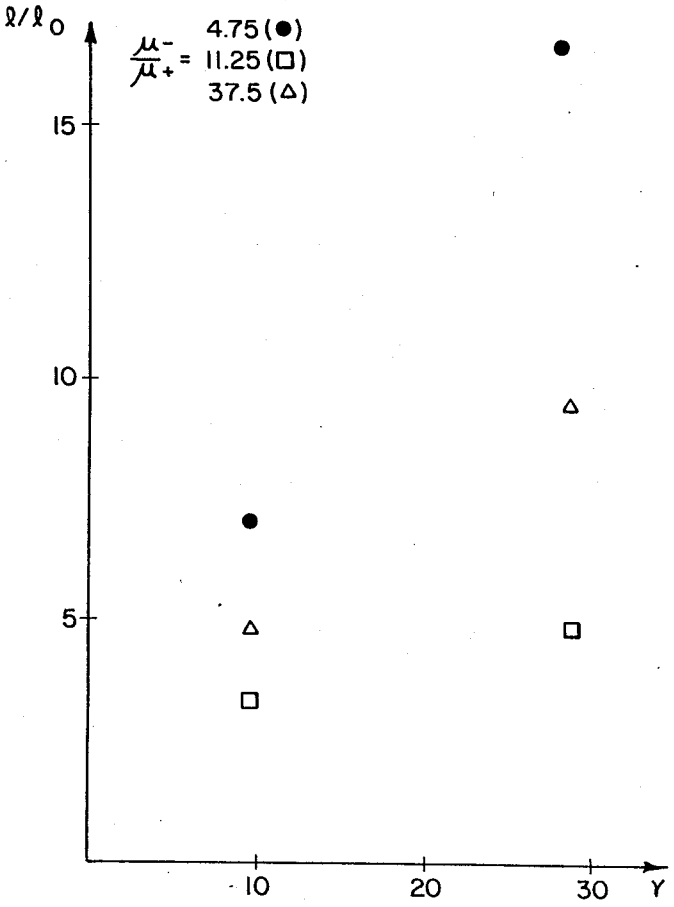
FIGS. 8–10 are plots of drop elongation versus strain for experiments conducted with different ratios of drop viscosity to surrounding-liquid viscosity.
Figure 9:
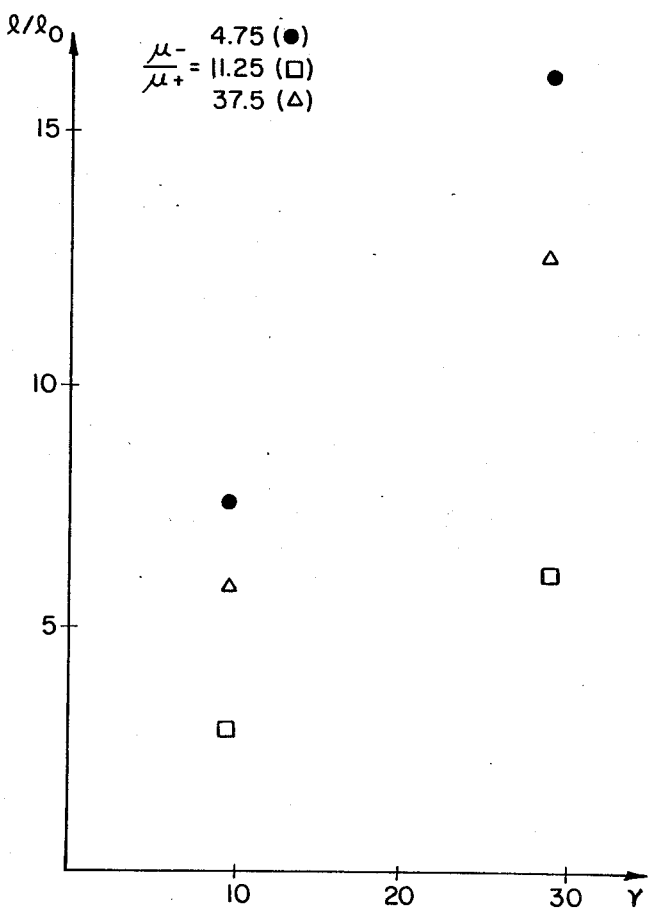

The tumbled mixture of pellets was placed in the mixing channel and heated to 160° C. The polymer melt 34 rested on a layer 36 of molten Wood's metal to provide a frictionless surface. Thermal degradation at the top surface (which would leave a thin layer of material with much higher viscosity) was inhibited by heating the apparatus in an evacuated oven. Shear strain was imparted to the mixture by turning the inner cylinder. After a prescribed amount of shear strain was imparted, the apparatus was cooled and the annular ring of solid polyethylene removed. Deformation of the more-viscous minor component was measured by counting the average number of occurrences of black component on cross-sectional slices cut from the ring. This gave an accurate measure of the average length to which the more-viscous pellets were stretched. The length of the more-viscous pellets is a measure of the amount of mixing that has occurred. Because temperature was held constant, the viscosity ratio between the components was the inverse of the corresponding melt index ratio. Mixing the black polyethylene with each of the three white polyethylenes gave three different viscosity ratios: 4.75, 11.25, and 37.5. The volume fraction of more-viscous drops was also varied, with data being gathered for 0, 10, and 20% volume fractions (0% volume fraction corresponds to a single high-viscosity pellet suspended in the lower viscosity melt). These data are represented in FIGS. 8 and 9.

Figure 10:
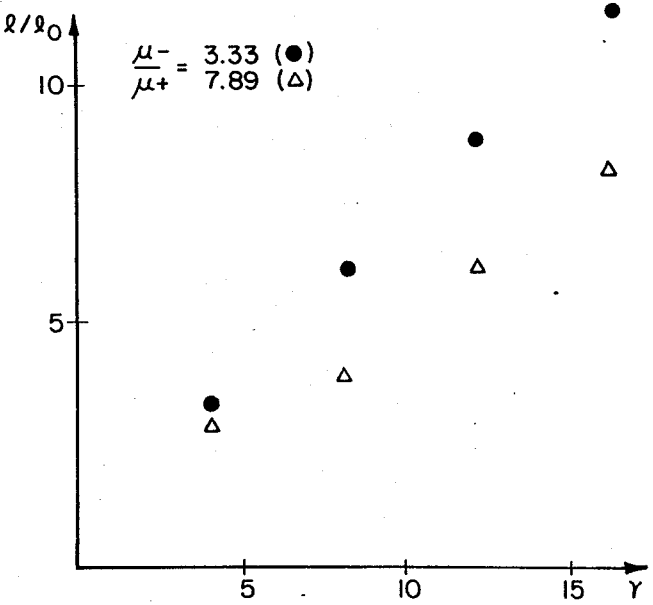

Experiments were also done using a few pigmented tracer drops in a mixture of otherwise clear polyethylenes. Using this procedure, elongation of the more-viscous drops could be viewed directly and photographed several times during each experiment. Data were obtained under these conditions for viscosity ratios of 7.89 and 3.33, for a volume fraction $\phi_v=0.10$. These data are presented in FIG. 10.

Figure 11:
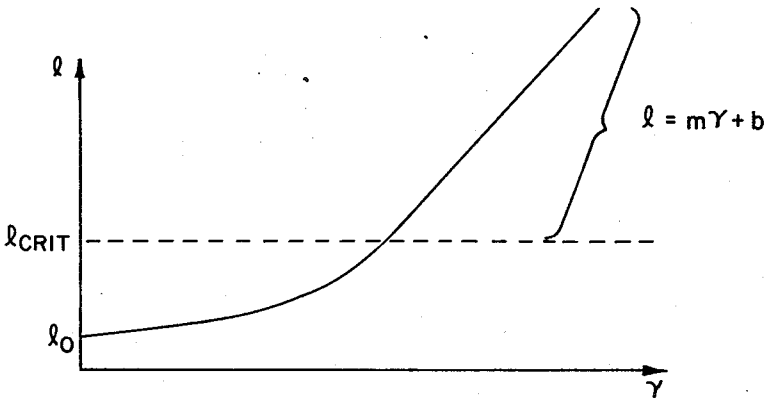
FIG. 11 is a generalized plot of drop elongation versus shear strain for the case of a more-viscous drop elongating in a less-viscous surrounding liquid.
Figure 12:
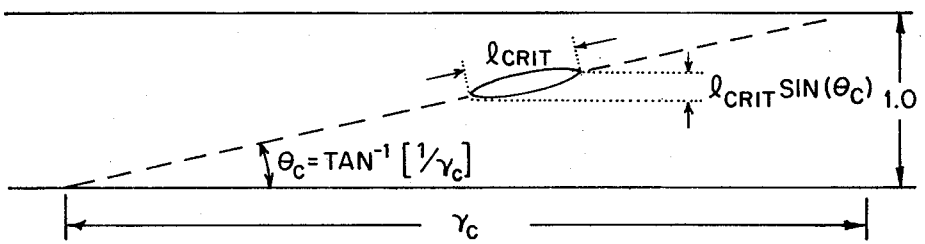
FIG. 12 is a view of an elongated drop showing its alignment with the shear in the surrrounding liquid.

A generalized plot of drop elongation $(l/l_o)$ versus shear strain is shown in FIG. 11 for the case of an initially-spherical, more-viscous drop. Drop elongation increases nonlinearly with shear strain until the drop length reaches the critical aspect ratio, $(l/d)_{crit}$. After that drop elongation increases linearly with shear strain. The slope m of the elongation versus strain curve is dependent on the amount of strain $(\gamma_c)$ at which the critical length is reached. The orientation of the drop at the stage of reaching critical aspect ratio is shown in FIG. 12. The drop has its longitudinal axis aligned with the shear. This alignment was observed in all of the shear mixing experiments. Mixing of the drop and surrounding liquid after this critical aspect-ratio stage will be governed by simple shear, despite the viscosity differences between the two liquids. It can thus be shown that further elongation of the drop is governed by the expression $$l = l_{crit}\left\{1 + (\gamma - \gamma_c)\left[\frac{1}{\gamma_c^2 + 1}\right]^{\frac{1}{2}}\right\}$$

where $$l_{crit} = \left[\frac{-9\ V_o \ln \phi_v}{\pi(\mu-/\mu+)}\right]^{\frac{1}{3}}$$

in which $V_o$ denotes drop volume. If this expression is rearranged into the form $l = m\gamma + b$, the rate of further mixing can be expressed as $$m = \frac{dl}{d\gamma} = l_{crit}\left[\frac{1}{\gamma_c^2 + 1}\right]^{\frac{1}{2}}$$

It can be readily seen, therefore, that the rate of mixing after the critical-aspect-ratio stage is strongly dependent on the amount of strain needed to elongate the drops to their critical aspect ratio. Thus, if prior to mixing, the drops are elongated to their critical aspect ratio or a substantial fraction thereof (e.g., 50%), a great increase in the rate of mixing can be achieved. In the case in which the drops begin the mixing process at their critical aspect ratio, the strain term $_c$ is zero.

Other embodiments of the invention are within the following claims.

For example, the viscosity ratio, $\mu+/\mu-$, may typically be anywhere in the range from 1 to 100, and the volume fraction, $\phi_v$, may range from just greater than zero to about 0.65.

What is claimed is:

1. The method of mixing viscous liquids of different viscosity wherein a more-viscous component is distributed discontinuously in a less-viscous phase, said method comprising the steps of forming a plurality of nonspherical, pre-elongated drops of the more-viscous component, thereafter combining said pre-elongated drops and less-viscous phase, and deforming the mixture of said pre-elongated drops and less-viscous phase to further elongate said drops, wherein said drops of more-viscous component are elongated to at least 50% of a critical aspect ratio $(l/d)_{crit}$, defined by the expression $$\left(\frac{l}{d}\right)_{crit} = \frac{3}{2}\left[-\ln \phi_v\left(\frac{\mu+}{\mu-}\right)\right]^{\frac{1}{2}}$$

wherein $(l/d)_{crit}$ is the critical aspect ratio, $\mu+$ is the viscosity of the more viscous drop, $\mu-$ is the viscosity of the less-viscous phase, and $\phi_v$ is the volume fraction occupied by the more-viscous drops.

2. The method of claim 1 wherein said drops of more-viscous component are equal to or longer than said critical aspect ratio.

3. The method of claim 1 wherein said viscous liquids consist of polymer melts and said elongated drops of more-viscous component are elongated pellets.

4. The method of claim 3 wherein said less-viscous phase consists of pellets of polymer melt.

5. The method of claim 4 wherein said pellets of more-viscous component are elongated in a pelletizer.

6. The method of claim 1 wherein said more-viscous component is the minority component in said mixture of liquids.

7. The method of claim 1 wherein said less-viscous phase consists of only one component.

8. The method of claim 1 wherein said less-viscous phase comprises drops of a less-viscous liquid.

9. The method of claim 1 wherein said less-viscous phase is continuously distributed in a continuous matrix.

10. The method of mixing viscous liquids of different viscosity wherein a more-viscous component in the form of drops is in the minority and surrounded by a less-viscous phase, said method comprising the steps of forming a plurality of nonspherical, pre-elongated drops of the more-viscous component, thereafter combining said pre-elongation drops and less-viscous phase, and deforming the mixture of said pre-elongated drops and less-viscous phase to further elongate said drops, wherein said drops of more-viscous component is elongated to at least 50% of a critical aspect ratio $(l/d)_{crit}$, defined by the expression $$\left(\frac{l}{d}\right)_{crit} = \frac{3}{2}\left[-\ln \phi_v\left(\frac{\mu+}{\mu-}\right)\right]^{\frac{1}{2}}$$

wherein $(l/d)_{crit}$ is the critical aspect ratio, $\mu+$ is the viscosity of the more-viscous drop, $\mu-$ is the viscosity of the less-viscous phase, and $\phi_v$ is the volume fraction occupied by the more-viscous drops.

11. The method of claim 10 wherein said drops of more-viscous component are equal to or longer than said critical aspect ratio.

12. The method of claim 10 wherein said viscous liquids consist of polymer melts and said elongated drops of more-viscous component are elongated pellets.

13. The method of claim 12 wherein said less-viscous phase consists of pellets of polymer melt.

14. The method of claim 13 wherein said pellets of more-viscous component are elongated in a pelletizer.

15. The method of claim 10 wherein said less-viscous phase consists of only one component.

16. The method of claim 10 wherein said less-viscous phase comprises drops of a less-viscous liquid.

17. The method of claim 10 wherein said less-viscous phase is continuously distributed in a continuous matrix.

18. The method of mixing viscous liquids of different viscosity wherein a more-viscous component is distributed discontinuously in a less-viscous phase, said method comprising the steps of forming a plurality of nonspherical, pre-elongated drops of the more-viscous component, thereafter combining said pre-elongated drops and less-viscous phase, and deforming the mixture of said pre-elongated drops and less-viscous phase to further elongate said drops, wherein said more-viscous pellets have an aspect ratio (l/d) greater than 5.0.

19. The method of mixing viscous liquids of different viscosity wherein a more-viscous component in the form of drops is in the minority and surrounded by a less-viscous phase, said method comprising the steps of forming a plurality of nonspherical, pre-elongated drops of the more-viscous component, thereafter combining said pre-elongated drops and less-viscous phase, and deforming the mixture of said pre-elongated drops and less-viscous phase to further elongate said drops, wherein said more-viscous pellets have an aspect ratio (l/d) greater than 5.0.

20. The method of claim 18 wherein said more-viscous pellets have an aspect ratio (l/d) greater than 10.0.

21. The method of claim 19 wherein said more-viscous pellets have an aspect ratio (l/d) greater than 10.0.

22. The method of claim 1 wherein said viscosity ratio $\mu+/\mu-$ is in the range 1 to 100.

23. The method of claim 10 wherein said viscosity ratio $\mu+/\mu-$ is in the range 1 to 100.

* * * * *